US009279648B2

(12) United States Patent
Marshall, Jr.

(10) Patent No.: US 9,279,648 B2
(45) Date of Patent: Mar. 8, 2016

(54) LIGHTED NOCK ACTIVATION MEANS AND PROCESSES THEREFOR

(71) Applicant: John F. Marshall, Jr., Destin, FL (US)

(72) Inventor: John F. Marshall, Jr., Destin, FL (US)

( * ) Notice: Subject to any disclaimer, the term of this patent is extended or adjusted under 35 U.S.C. 154(b) by 0 days.

(21) Appl. No.: 14/090,331

(22) Filed: Nov. 26, 2013

(65) Prior Publication Data

US 2014/0148284 A1 May 29, 2014

Related U.S. Application Data

(60) Provisional application No. 61/729,901, filed on Nov. 26, 2012, provisional application No. 61/749,050, filed on Jan. 4, 2013, provisional application No. 61/749,262, filed on Jan. 5, 2013.

(51) Int. Cl.

| | |
|---|---|
| ***F42B 6/06*** | (2006.01) |
| ***F42B 12/36*** | (2006.01) |
| ***F42B 12/38*** | (2006.01) |

(52) U.S. Cl.

CPC . *F42B 6/06* (2013.01); *F42B 12/36* (2013.01); *F42B 12/382* (2013.01)

(58) Field of Classification Search

CPC ..... F42B 6/06
USPC ..... 473/570, 578, 585, 586
See application file for complete search history.

(56) References Cited

U.S. PATENT DOCUMENTS

| | | | | |
|---|---|---|---|---|
| 2,525,332 | A | 10/1950 | Alger et al. | |
| 3,749,403 | A | 7/1973 | Austin et al. | |
| 4,340,930 | A | 7/1982 | Carissimi | |
| 4,547,837 | A * | 10/1985 | Bennett | 362/186 |
| 4,615,552 | A | 10/1986 | Bengtson | |
| 5,134,552 | A * | 7/1992 | Call et al. | 362/203 |
| 7,021,784 | B2 | 4/2006 | DiCarlo | |
| 7,229,371 | B2 | 6/2007 | Walsh | |
| 7,758,457 | B2 | 7/2010 | Marshall | |
| 7,837,580 | B2 * | 11/2010 | Huang et al. | 473/570 |
| 7,892,119 | B2 | 2/2011 | Marshall | |
| 7,922,609 | B1 | 4/2011 | Hajari | |
| 7,931,550 | B2 * | 4/2011 | Lynch | 473/578 |
| D641,827 | S | 7/2011 | Errett | |
| 7,993,224 | B2 * | 8/2011 | Brywig | 473/586 |
| 8,267,816 | B1 | 9/2012 | Hajari | |
| 8,382,616 | B2 | 2/2013 | Marshall | |
| 2012/0100942 | A1 | 4/2012 | Minica | |

* cited by examiner

*Primary Examiner* — John Ricci
(74) *Attorney, Agent, or Firm* — The Webb Law Firm

(57) ABSTRACT

A lighted nock assembly is disclosed for use with an archery projectile. A portion of an insert fits within, and is shouldered against, the tail end of the projectile shaft. The insert includes a recess terminating in a floor portion, and a face to bear against the nock shoulder. An LED/battery assembly fits within the recess of the insert abutting the floor portion. A nock fits over the LED/battery assembly and into the recess of the insert. Ready-to-fire, the LED/battery assembly comprises an activation gap between the LED lamp and the body of the battery assembly. A gap, greater than or equal to the activation gap, is left between the shoulder of the nock and the face of the insert. When fired, the bow string drives an internal surface of the nock into the front end of the LED/battery assembly and illuminates the LED lamp.

21 Claims, 2 Drawing Sheets

LIGHTED NOCK ACTIVATION MEANS AND PROCESSES THEREFOR

CROSS-REFERENCE TO RELATED APPLICATIONS

The present U.S. non-provisional patent application claims priority to, and full benefit of, each of the following: U.S. provisional patent application Ser. No. 61/729,901, filed Nov. 26, 2012, and entitled, "Universal Lighted Nock And Processes Therefor;" U.S. provisional patent application Ser. No. 61/749,050, filed Jan. 4, 2013, and entitled, "Vane For Bolts, Arrows, And The Like;" and U.S. provisional patent application Ser. No. 61/749,262, filed Jan. 5, 2013, and entitled, "Lighted Nock Activation Means And Processes Therefor;" the disclosures of each being incorporated by reference herein.

TECHNICAL FIELD

The present invention relates, generally, to nocks for use with arrows, cross-bow bolts, and the like; and, more particularly, to lighted nocks and activations means for use therewith.

BACKGROUND

In archery, it is well-known that a nock is associated with the rearmost portion of an arrow, cross-bow bolt, and the like. A bowstring fits into the nock and propels the arrow from the bow upon release. With the advent of translucent plastic nocks, along with the advent of small-profile light emitting diode ("LED") and battery assemblies, it was recognized that the tail portion of an arrow could be lighted by fitting an LED/battery assembly within the translucent nock. It was recognized, advantageously, that such a lighted nock could provide a means to track arrow flight and targeting, such as may be useful at night, in low light conditions, or in poor visibility situations.

Notwithstanding, reliable, consistent, and convenient activation of such small-profile LED and battery assemblies has proven challenging to manufacturers. This problem was described in greater detail in Applicant's U.S. Provisional Patent Application Ser. No. 61/729,901, filed on Nov. 26, 2012, entitled, "Universal Lighted Nock and Processes Therefor," and U.S. provisional patent application Ser. No. 61/749,050, filed Jan. 4, 2013, and entitled, "Vane For Bolts, Arrows, And The Like," the disclosures of which are incorporated herein by reference.

As described therein, U.S. Pat. No. 4,340,930, issued Jul. 20, 1982 to Carissimi, and United States Patent Application Publication US 2012/0100942 by Minica, published Apr. 26, 2012, provide examples of such products. Disadvantageously, such products typically are formed in integral units, wherein a user cannot substitute a nock or an LED/battery assembly of his own choosing. Rather, a user is captive to a particular manufacturer's device construction, nock and LED color selections, and product availability. Additionally, due to the sealed and/or closed nature of such devices, switching off the LED/battery assembly after activation can sometimes be difficult and can tax one's dexterity—especially in field-use conditions.

Accordingly, in Applicant's above-referenced patent document, Applicant further disclosed embodiments of lighted nock subject matter that solve the aforedescribed activation problem for many projectile configurations. Advantageously, Applicant's disclosed subject matter provides a more universal construction, whereby a user conveniently may gain access to the working components, whereby those components may be transferred to other arrows, whereby the user may substitute nocks and LED/battery assemblies of his choice, and whereby the user can more easily access the LED/battery assembly to activate and deactivate the assembly without undue difficulty—all in field-use conditions.

It would be further desirable, however, to provide a lighted nock assembly that would provide for use of a standardized nock and for use of a standardized size, length, style, and/or configuration of small-profile LED and battery assembly within any of the several standardized arrow and cross-bow bolt sizes available in the marketplace. In order to do so, it would be beneficial to provide an insert for use within a conventional arrow or bolt shaft, the insert being appropriately sized on one end to accommodate and provide for use of such a standardized nock and standardized small-profile LED and battery assembly, while being appropriately sized on an opposite end to fit within, and be affixed into, a particular sized conventional arrow or bolt shaft.

It is to the disclosure of such lighted nock assemblies and related processes of use that the following is directed.

SUMMARY

In general, the present disclosure is directed to lighted nocks for use with arrows, cross-bow bolts, and the like. Specifically, and pursuant to a preferred embodiment of the present disclosure, an insert is provided for use within a conventional arrow or bolt shaft, the insert being appropriately sized on one end to receive, accommodate, and provide for use of such a standardized nock and standardized small-profile LED and battery assembly, while being appropriately sized on an opposite end to fit within, and be affixed into, a conventional arrow or bolt shaft.

Accordingly, an insert pursuant to the present subject matter comprises, at its leading end, an extended portion with diameter sized to fit within the tail end of a standard tubular arrow or bolt shaft, and a shoulder to bear against the tail end of the tubular arrow or bolt shaft. At its trailing end, the insert comprises a cavity to receive a standardized nock and standardized small-profile LED and battery assembly, and a face to bear against the shoulder of the nock.

The insert cavity terminates at a floor. A small-profile LED and battery assembly fits within the cavity of the insert, the tail end of the small-profile LED and battery assembly abutting the floor portion of the insert cavity. The floor may be integral and solid, or may be a partial floor (e.g., comprising a hole or other structure), so long as such partial floor does not allow the tail end of the small-profile LED and battery assembly to pass therethrough. The tail end of a nock fits over the small-profile LED and battery assembly and into the cavity of the insert.

In ready-to-fire position, the small-profile LED and battery assembly is in deactivated position, comprising an activation gap between the LED lamp and the body of the battery assembly. A corresponding gap, greater than or equal to the activation gap, is left between the shoulder of the nock and the face of the insert.

When fired, the bow string drives an internal surface of the nock into the front end of the small-profile LED and battery assembly. Because the tail end of the small-profile LED and battery assembly is in contact with the floor portion of the insert cavity, the driving force of the nock acts to close the activation gap; thereby, illuminating the LED lamp.

To reset the assembly for firing anew, one simply removes the nock and resets the small-profile LED and battery assembly to its deactivated position, which is done by pulling the LED lamp to reopen the activation gap. One then places the small-profile LED and battery assembly and nock into their ready-to-fire position within the cavity of the insert, leaving a gap as described above.

Accordingly, and advantageously, the subject matter of the present disclosure provides a user with a lighted nock configuration that provides a more universal construction than has heretofore been developed in the known prior art, whereby a user conveniently may gain access to the working components, whereby certain of those components may be transferred to other arrows, whereby the user may make use of a standardized nock and standardized small-profile LED and battery assembly, and whereby the user can more easily access the small-profile LED and battery assembly to activate and deactivate the assembly without undue difficulty—all in field-use conditions.

These and other features and advantages of the various embodiments of lighted nock assemblies for use with arrows, cross-bow bolts, and the like, and related processes for use thereof, as set forth within the present disclosure, will become more apparent to those of ordinary skill in the art after reading the following Detailed Description of Illustrative Embodiments and the Claims in light of the accompanying drawing Figures.

BRIEF DESCRIPTION OF THE DRAWINGS

Accordingly, the within disclosure will be best understood through consideration of, and with reference to, the following drawing Figures, viewed in conjunction with the Detailed Description of Illustrative Embodiments referring thereto, in which like reference numbers throughout the various Figures designate like structure, and in which.

Figure 1:
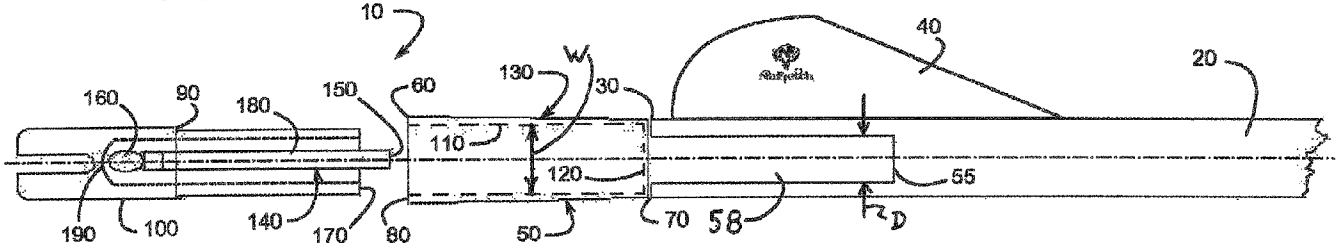
FIG. 1 is an exploded view of the subject matter of the present disclosure.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing the several embodiments illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose. Additionally, in the Figures, like reference numerals shall be used to designate corresponding parts throughout the several Figures.

Figure 2:
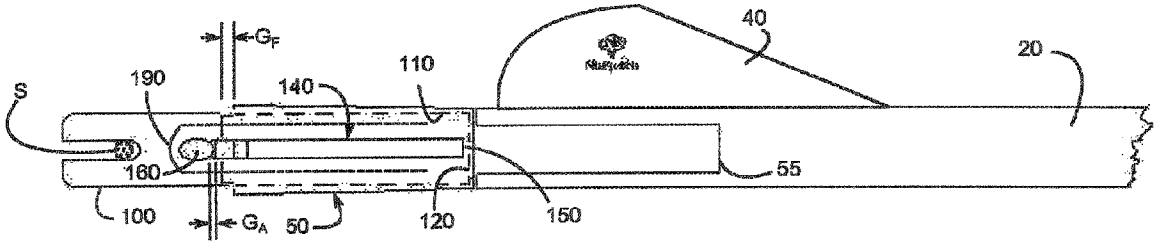
FIG. 2 illustrates the device of FIG. 1 in assembled, ready-to-fire position.
Figure 3:
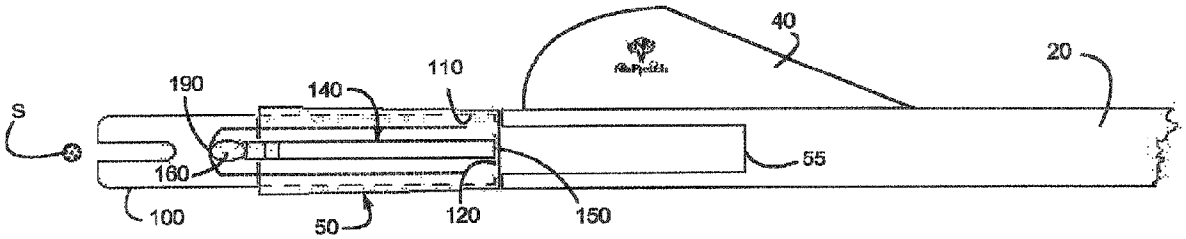
FIG. 3 illustrates the device of FIG. 2 in assembled, just-fired position.

Illustrated in FIGS. 1-3 is a preferred embodiment of lighted nock assembly 10 for use with arrows, cross-bow bolts, and the like, according to the subject matter of the present disclosure. With reference to FIG. 1, conventional, tubular arrow or bolt shaft 20 comprises tail end 30. To arrow shaft 20 are typically attached three fletch members 40, the fletch members used to stabilize the arrow during flight.

In order to prepare an arrow to receive lighted nock assembly 10 of the present disclosure, one removes any prefitted nock from tail end 30 of arrow or bolt shaft 20. In lieu thereof, and as will be further described herein, a leading end portion of insert 50 is configured to fit within the tail end 30 of tubular arrow or bolt shaft 20.

It is here noted that insert 50 is sometimes referred to as a "half-out" design; however, that term is herein used differently from the ordinary meaning of said term in the art. In the art, a "half-out" design refers to an arrow insert utilized adjacent the leading end of an arrow to carry, for example, a broadhead-type point. In the present subject matter, however, the term, "half out," designates an insert utilized adjacent the trailing end of an arrow to carry and function in association with, for example, lighted nock assembly 10 of the present subject matter. The term, "half-out," accordingly describes the appearance of insert 50, approximately ½ of which is configured to be disposed within the arrow shaft, and approximately ½ of which is configured to be disposed outside of the arrow shaft, all as described more fully herein. It will be appreciated by those of ordinary skill in the art, however, that the relative lengths of that portion of insert 50 which is configured to be disposed within the arrow shaft and that portion of insert 50 which is configured to be disposed outside the arrow shaft may vary in design and construction consistent with the intended use and application of insert 50.

As described above, insert 50 comprises, at a leading end 55, an extended portion (58) with any outer diameter (D) configured to fit within the tail end 30 of tubular arrow or bolt shaft 20. In a preferred embodiment, approximately mid-way between leading end 55 and the tail end 60, insert 50 comprises shoulder 70. Shoulder 79 is configured to bear against tail end 30 of tubular arrow or bolt shaft 20. At trailing end 60, face 80 of insert 50 is configured to bear against shoulder 90 of nock 100.

It is noted that, in some embodiments, insert 50 is constructed of aluminum; however, any material may be used that would be suitable to the intended applications and uses described herein. It is noted that, for a secure fit, a user optionally may bond insert 50 into tail end 30 of tubular arrow or bolt shaft 20 by use of any suitable adhesive. In some embodiments, leading end 55 of insert 50 may be knurled, ridged, grooved, undercut, split, colletted, and/or otherwise configured so as to provide a suitable surface for application and use of such adhesive, and/or so as to provide a suitable fit of leading end 55 of insert 50 within tail end 30 of tubular arrow or bolt shaft 20.

Insert 50 further comprises recess 110 (sometimes called cavity 110) extending within the trailing end (60), terminating in floor portion 120. The recess (110) has a width (W) greater than the outer diameter (D) of the extended portion (58). Outside profile 130 of insert 50 may be suitably configured, such as through a tapered outside diameter, a uniform outside diameter, a stepped outside diameter, a concave, convex, or complex-shaped, or other form of outside diameter, without limitation, so as to provide an aesthetically pleasing, tactilely pleasing, aerodynamic, and/or otherwise appropriately interconnecting surface between nock 100 and an outside diameter of tubular arrow or bolt shaft 20.

Small-profile LED and battery assembly 140 fits within cavity 110 of insert 50, tail end 150 of small-profile LED and battery assembly 140 abutting floor portion 120 of insert 50. It is noted that floor portion 120 of insert 50 may be integral and solid, or may be a partial floor (e.g., comprising a hole, boss, recess, stop means, pin, or other structure), so long as such partial floor does not allow tail end 150 of small-profile LED and battery assembly 140 to pass therethrough.

In most circumstances, it is preferred that small-profile LED and battery assembly 140 initially be in open, deactivated configuration, so that the user's night vision is not interrupted by the brightly illuminated LED lamp 160, and so that a user's field position remains concealed prior to firing.

In ready-to-fire position, best seen with reference to FIG. 2, tail end 170 of nock 100 fits over small-profile LED and battery assembly 140 and into recess 110 of insert 50. As described above, small-profile LED and battery assembly 140 preferably remains in deactivated position, comprising activation gap $G_A$ between the LED lamp 160 and body 180 of small-profile LED and battery assembly 140. A corresponding firing gap $G_F$, greater than or equal to activation gap $G_A$, is left between shoulder 90 of nock 100 and face 80 of insert 50.

Best seen with reference to FIG. 3, when the arrow or bolt, so configured, is fired, bow string S drives internal surface 190 of nock 100 into the head end of small-profile LED and battery assembly 140 adjacent LED lamp 160. Because tail end 150 of small-profile LED and battery assembly 140 is in contact with floor portion 120 of insert 50, the driving force of nock 100 acts to close firing gap $G_F$, and, in turn, activation gap $G_A$; thereby, illuminating LED lamp 160.

To reset lighted nock assembly 10 for firing anew, one simply removes nock 100 and resets small-profile LED and battery assembly 140, which is removably disposed within the recess of the nock (100), to its deactivated position, which typically is done by pulling LED lamp 160 to reopen activation gap $G_A$. One then places small-profile LED and battery assembly 140 and nock 100 into their ready-to-fire position within insert 50, leaving firing gap $G_F$ as described above.

It is noted that, in some embodiments, small-profile LED and battery assembly 140 may comprise an LED with built-in, pin type lithium battery, such as the JNJ R-type assembly (JNJ Co., LTd., Korea). Suitably configured; however, lighted nock assembly 10 may be used in association with any of a variety of small-profile LED and battery assemblies currently on the market.

Figure 4:
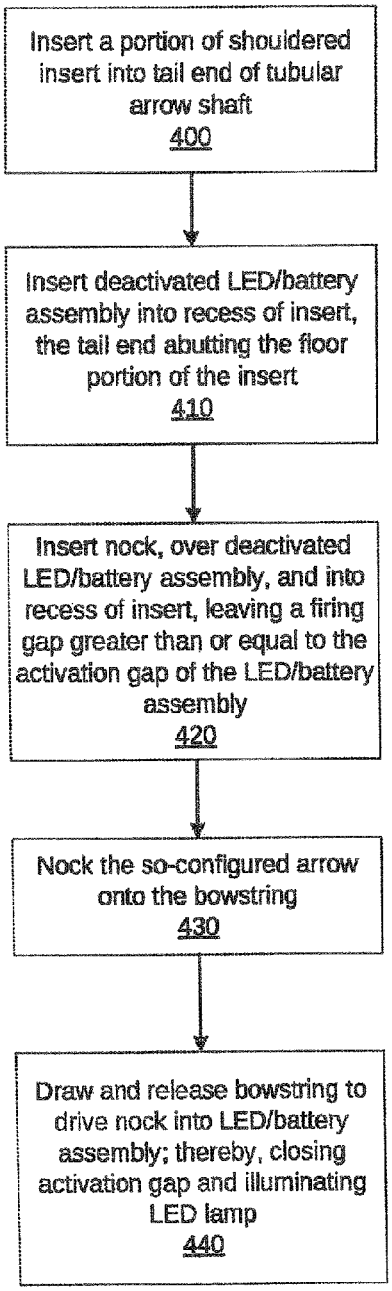
FIG. 4 is a flowchart illustrating a process for using a lighted nock according to the subject matter of the present disclosure.

Turning now to FIG. 4, the above-described steps for configuring and firing an arrow carrying a lighted nock assembly in accordance with the present disclosure are outlined in process flowchart form. At step 400, one inserts a shouldered insert, such as, for example, insert 50, into the tail end of a tubular arrow or bolt shaft. At step 410, one inserts a deactivated small-profile LED and battery assembly, such as, for example, small-profile LED and battery assembly 140, into a recess within the insert. Tail end of the small-profile LED and battery assembly should abut a floor portion within the insert.

At step 420, a nock, such as, for example, nock 100, is inserted over the deactivated small-profile LED and battery assembly and into the recess of the insert. A firing gap greater than or equal to the activation gap of the small-profile LED and battery assembly should be maintained.

At step 430, the arrow or bolt, configured as described above, is nocked onto the bowstring. At step 440, the bowstring is drawn and released, driving the nock into the small-profile LED and battery assembly; thereby, closing the firing gap and the activation gap, and illuminating the LED lamp.

Figure 5:
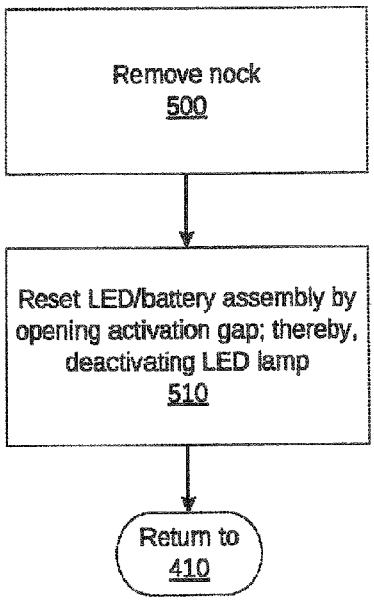
FIG. 5 is a flowchart illustrating a process for resetting and reusing a lighted nock according to the subject matter of the present disclosure.

Referring now to FIG. 5, the above-described steps for resetting and readying for refiring an arrow or bolt carrying a lighted nock in accordance with the present disclosure are outlined in process flowchart form. At step 500, the nock is removed. At step 510, the small-profile LED and battery assembly is reset to a deactivated condition by opening the activation gap. At this point, one may ready the lighted nock for refiring by returning to the process of FIG. 4, step 410.

In view of the aforedescribed subject matter, it will be seen that, advantageously, and distinctly in view of known prior art lighted nock assemblies, insert 50 may be used within a conventional arrow or bolt shaft, insert 50 being appropriately sized on one end to receive, accommodate, and provide for use of a standardized nock and standardized small-profile LED and battery assembly, while being appropriately sized on an opposite end to fit within, and be affixed into, a conventional arrow or bolt shaft.

Further advantageously, the subject matter of the present disclosure provides a user with a lighted nock assembly configuration that provides a more universal construction than has heretofore been developed in the known prior art, whereby a user conveniently may gain access to the working components, whereby certain of those components may be transferred to other arrows, whereby the user may make use of a standardized nock and standardized small-profile LED and battery assembly, and whereby the user can more easily access the small-profile LED and battery assembly to activate and deactivate the assembly without undue difficulty—all under field-use conditions.

Having thus described exemplary embodiments of the subject matter of the present disclosure, it is noted that the within disclosures are exemplary only and that various other alternatives, adaptations, and modifications may be made within the scope and spirit of the present invention. For example, while the disclosure set forth hereinabove has been provided with primary reference to conventional arrows, the subject matter could be extended to use in association with bolts for use in association with cross-bows, or the like, without limitation.

Furthermore, the subject matter of the present disclosure may be utilized in association with target practice, situational shooting, and/or the like, as well as with hunting and other in-field uses.

In some embodiments, the subject matter of the present disclosure may be provided in packaged form comprising one or more suitably configured nock, small-profile LED and battery assembly, and insert. In such form, a user may utilize his own arrow or bolt in association with the subject matter of the present disclosure In some embodiments, the subject matter of the present disclosure may be provided in packaged form comprising one or more, optionally pre-fletched, arrow or bolt, along with one or more suitably configured nock, small-profile LED and battery assembly, and insert.

Accordingly, the present subject matter is not limited to the specific embodiments as illustrated herein, but is only limited by the following claims.

What is claimed:

1. A lighted nock assembly for use with an arrow or bolt, the lighted nock assembly comprising:

an insert having at a leading end an extended portion with a diameter configured to fit within a tail end of said arrow or bolt and a trailing end with a recess extending therein, wherein said recess has a width greater than said diameter of said extended portion, an LED and battery assembly disposed within said recess in said insert, and a nock, wherein at least a portion of said nock is configured to fit in frictional engagement within said recess of said insert.

2. The lighted nock assembly of claim 1 wherein said insert further comprises a shoulder and a floor portion within the recess.

3. The lighted nock assembly of claim 2 wherein said insert further comprises a face.

4. The lighted nock assembly of claim 3 wherein said shoulder of said insert is configured to abut said tail end of the arrow or bolt.

5. The lighted nock assembly of claim 4 wherein said nock comprises a shoulder configured to abut said face of said insert.

6. The lighted nock assembly of claim 1 in a ready-to-fire configuration comprising a firing gap between a shoulder of said nock and a face of said insert, the firing gap being greater than or equal to an activation gap of said LED and battery assembly.

7. The lighted nock assembly of claim 1, wherein said LED and battery assembly may be configured to comprise an actuation gap.

8. The lighted nock assembly of claim 1, wherein the LED and battery assembly is removably disposed within the recess of the nock.

9. A lighted nock assembly for use with an arrow or bolt, the lighted nock assembly comprising:

an insert, an LED and battery assembly, and a nock, wherein at least a portion of said nock is configured to fit in frictional engagement within a recess of said insert, and wherein said nock comprises an internal recess terminating in an internal surface, said internal surface for contacting said LED lamp of said LED and battery assembly.

10. A projectile for archery comprising:

a tubular shaft;

an insert partially disposed within a tail end of said tubular shaft, wherein said insert has at a leading end an extended portion with a diameter configured to fit within a tail end of said projectile and a trailing end with a recess extending therein, wherein the recess has a width greater than said diameter of said extended portion, an LED and battery assembly disposed within said recess in said insert, and a nock disposed within said recess in said insert, said nock encompassing said LED and battery assembly within a recess formed within said nock.

11. The projectile of claim 10 wherein said insert further comprises a floor and a shoulder.

12. The projectile of claim 11 wherein said insert further comprises a face.

13. The projectile of claim 12 wherein said shoulder of said insert is configured to abut said tail end of said tubular shaft.

14. The projectile of claim 12 wherein said nock further comprises a shoulder configured to abut said face of said insert, and an internal surface within said recess of said nock, said internal surface for contacting said LED lamp of said LED and battery assembly.

15. The projectile of claim 10 wherein at least a portion of said nock is configured to fit in frictional engagement within said recess of said insert.

16. The projectile of claim 10 wherein said LED and battery assembly may be configured to comprise an activation gap.

17. The projectile of claim 16 in a ready-to-fire configuration comprising a firing gap between a shoulder of said nock and a face of said insert, the firing gap being greater than or equal to said activation gap of said LED and battery assembly.

18. A process for using a lighted nock assembly in association with an arrow, the process comprising the steps of:

(a.) inserting a portion of a shouldered insert into the tail end of a tubular arrow shaft;

(b.) inserting a deactivated LED and battery assembly into a recess within the insert, the tail end of the LED and battery assembly abutting a floor portion of the insert;

(c.) inserting a nock over the LED and battery assembly and into the recess within the insert;

(d.) establishing a firing gap between a shoulder of the nock and a face of the insert, the firing gap being greater than or equal to an activation gap of the LED and battery assembly;

(e.) nocking the arrow onto a bowstring, and (f.) drawing and releasing the bowstring, driving the nock into the LED and battery assembly; thereby, closing the firing gap and the activation gap, and illuminating an LED lamp associated with the LED and battery assembly.

19. A lighted nock assembly for use with an arrow or bolt, the lighted nock assembly comprising:

an insert having at a leading end an extended portion with a diameter configured to fit within a tail end of said arrow or bolt and a trailing end with a recess extending therein, wherein said recess has a width greater than said diameter of said extended portion, wherein said insert further comprises a floor, a shoulder and a face, an LED and battery assembly, a nock, and wherein said shoulder of said insert is configured to abut a tail end of the arrow or bolt.

20. The lighted nock assembly of claim 19 wherein said nock comprises a shoulder configured to abut said face of said insert.

21. A lighted nock assembly for use with an arrow or bolt, the lighted nock assembly comprising:

an insert having at a leading end an extended portion with a diameter configured to fit within a tail end of said arrow or bolt and a trailing end with a recess extending therein, wherein said recess has a width greater than said diameter of said extended portion, an LED and battery assembly disposed within said recess of said insert, wherein said LED and battery assembly may be configured to comprise an actuation gap, and a nock.

* * * * *